US005443188A

United States Patent [19]

Kotlarsky et al.

[11] Patent Number: 5,443,188

[45] Date of Patent: Aug. 22, 1995

[54] SYSTEM FOR SIMULATING HUMAN GAIT

[76] Inventors: Boris Kotlarsky, 10/9 Shikun Yoseftal, Hadera; Gideon Gelman, 36/4 Arlozoroff St., Petach Tikva, both of Israel

[21] Appl. No.: 225,289

[22] Filed: Apr. 8, 1994

[51] Int. Cl.[6] ..... D06C 15/00; G09F 19/08; A63H 11/00; A63M 13/00

[52] U.S. Cl. ..... 223/66; 40/415; 40/414; 40/420; 446/358; 446/359

[58] Field of Search ..... 223/66, 120; 40/415, 40/414, 420, 472; 446/358, 359, 365

[56] References Cited

U.S. PATENT DOCUMENTS

| | | | |
|---|---|---|---|
| 624,799 | 5/1899 | Haueis | 223/66 |
| 692,604 | 2/1902 | Bourke | 40/420 |
| 1,903,371 | 4/1933 | Connor | 446/358 |
| 2,882,050 | 4/1959 | Deady | 446/359 |
| 3,393,470 | 7/1968 | Salvador | 40/415 |
| 3,672,092 | 6/1972 | Tepper et al. | 446/359 |
| 4,407,083 | 10/1983 | Hartgrave | 40/414 |
| 4,901,459 | 2/1990 | Lee | 40/414 |

*Primary Examiner*—Clifford D. Crowder
*Assistant Examiner*—Bibhu Mohanty
*Attorney, Agent, or Firm*—Mark M. Friedman

[57] ABSTRACT

A system for simulating human gait embodied as a human-like model, for example, a mannequin, a scarecrow and the like depending on the intended application of the system, driven by a driving system along a pair of tracks. The driving system includes rotatable terminals for reversing the direction of advancement of the model. The model has legs which are pivotally connected to one another in a spaced alignment at a waist enabling a scissor-like action during the step-by-step advancement of the model along the tracks. The waist includes a balancing mechanism for maintaining a substantially even keel of the model during the gait-like motion. Furthermore, the legs include an upper segment pivotally connected at a knee-like joint to a lower segment such the legs have a tendency for a flexion movement and urging mechanisms for straightening them. Still further, the legs terminate in feet pivotally connected thereto which are provided with front and rear shock absorbers for smoothing the gait-like motion.

8 Claims, 10 Drawing Sheets

SYSTEM FOR SIMULATING HUMAN GAIT

FIELD AND BACKGROUND OF THE INVENTION

The present invention relates to systems for simulating human movement in general and, in particular, to systems for simulating human gait.

Mannequins for displaying clothing in window displays have been known for many years. However, the window displays suffer from a lack of eye catching appeal due to the static poise of the mannequins. Recent attempts to enhance the eye catch appeal of window displays have included mounting mannequins on conveyor belts such that they glide in a continuous motion.

However, in practice, the mere continuous gliding of a mannequin lacks any real eye catching appeal and therefore it would be highly desirable to have a mannequin that simulates the human gait to create a more life-like, eye catching window display.

SUMMARY OF THE INVENTION

The main object of the present invention is for a system which simulates human gait having particular application for mannequins to create more life-like, eye catching window displays.

The major dynamic features of human gait for a person of average height walking at between 3–5 km/hr include a typical step length of 60–70 cm, a typical 50°–60° subtended angle between legs at maximum stride and a typical 15° pitch motion of feet between take-off and landing, all while maintaining a substantially even keel of the body and a slight undulating height.

Hence, to simulate human gait in a life-like as possible fashion, the system is required to both display dimensions approximating those of a human body and more or less the dynamic features of human gait as described above.

Therefore, according to the present invention, there is provided a system for simulating human gait, comprising: (a) a first track; (b) a right leg for advancement along the first track; (c) first driving means for advancing the right leg a step forward along the first track; (d) a second track substantially parallel to the first track; (e) a left leg for advancement along the second track; (f) second driving means for advancing the left leg a step forward along the second track; and (g) control means for alternately activating the first and second driving means for advancing the right and left legs in a gait-like motion.

The system is preferably fashioned as a human-like model, for example, a mannequin, a scarecrow and the like depending on the intended application of the system. The upper ends of the legs are pivotally connected to one another in a spaced alignment at a waist enabling a scissor-like action during the step-by-step advancement of the model along the tracks.

The driving system for advancing the model step-by-step along the tracks includes a pair of belt-driven carriages which are detachably engaged to legs through wheeled carriages supporting the model which run on the tracks. The belt-driven carriages themselves mn on a second pair of substantially parallel tracks lying in a spaced underneath alignment to the first pair of tracks. The driving system further includes limit switches for detecting when the model has reached the ends of the tracks and rotatable terminals for reversing the direction of advancement of model.

The waist includes a balancing mechanism for maintaining a substantially even keel of the model during the gait-like motion. Furthermore, the legs include an upper segment pivotally connected at a knee-like joint to a lower segment such that the legs have a tendency for a flexion movement and urging means for straightening them. Still further, the legs terminate in feet pivotally connected thereto which are provided with front and rear shock absorbers for smoothing the gait-like motion.

In summary, the present invention is of a unique system having elements which are designed in terms of their weight, moments of inertia and other static and dynamic properties to spatially and temporally cooperate to simulate human gait.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is of a system for simulating human gait embodied as a human-like model driven along a pair of tracks by a driving system in a gait-like fashion.

The principles and operation of the system, generally designated 100, of the present invention may be better understood with reference to the drawings and the accompanying description.

Figure 1A:
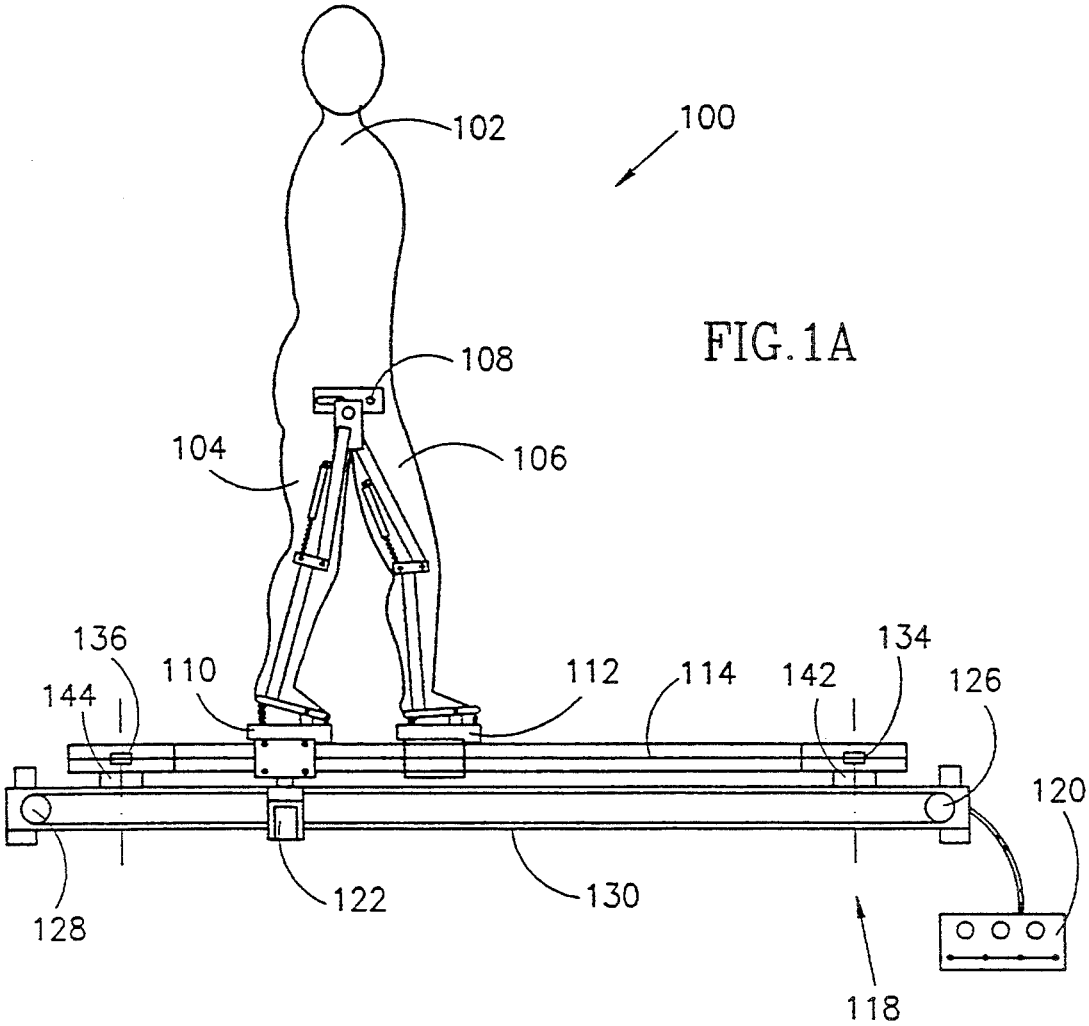
FIGS. 1*a* and 1*b* show side and top views of a system for simulating human gait embodied as a human-like model driven by a driving system along a pair of tracks according to the teachings of the present invention.
Figure 1B:
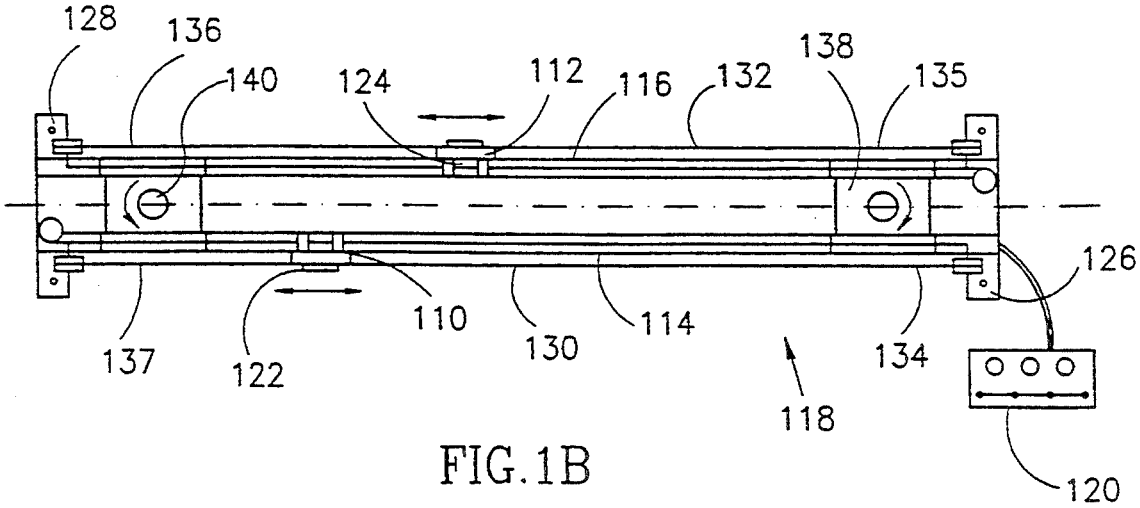

Referring now to the drawings, FIG. 1 shows a human-like model 102, for example, a mannequin, a scarecrow and the like, depending on the intended application of system 100, having a right leg 104 and a left leg 106 pivotally connected in a spaced alignment to one another through a waist 108. Right and left legs 104 and 106 are mounted on a pair of wheeled carriages 110 and 112 which run along a pair of parallel tracks 114 and 116. Tracks 114 and 116 have a typical length of 180 cm.

A driving system 118, under the control of a controller 120, advances model 102 step-by-step along tracks 114 and 116 by means of a pair of belt-driven carriages 122 and 124 which detachably engage carriages 110 and 112. Carriages 122 and 124 are driven by motors 126 and 128 along a second pair of parallel tracks 130 and 132 in a spaced underneath alignment to tracks 114 and 116.

It is a feature of the present invention, that driving system 118 advances model 102 in both left-to-right and right-to-left directions. For left-to-right advancement of model 102, right and left carriages 110 and 112 run along tracks 114 and 116, respectively, while for right-to-left advancement of model 102, carriages 110 and 112 run along tracks 116 and 114, respectively.

Limit switches 134 and 135 detect arrival of legs 104 and 106, respectively, at the right end of tracks 114 and 116 while limit switches 136 and 137 detect arrival of legs 104 and 106, respectively, at the left end of tracks 114 and 116. Limit switches 134–137 provide signals to controller 120 to reverse engagements between carriages 110 and 112 and tracks 114 and 116 through the use of rotatable terminals 138 and 140 driven by motors 142 and 144. It should be noted that terminals 138 and 140 include end portions of tracks 114 and 116.

With reference now to FIGS. *2a* and *2b*, right and left legs 104 and 106 can be seen to have the same elements which are therefore likewise numbered in the following description with reference to right leg 104 only.

Right leg 104 generally includes an upper segment 148 pivotally connected at a knee-like joint 150 to a lower segment 152 such that leg 104 has a tendency for a flexion movement denoted by arrow A. Knee-like joint 150 is implemented by lower segment 152 having a T-shaped head 154 to which upper segment 148 is connected at a forward point 156 thereof.

To oppose the tendency for flexion movement of leg 104, a spring 158 is provided under tension between a rear point 160 of T-shaped head 154 and a point 162 midway along upper segment 148 for substantially straightening upper and lower segments 148 and 152. The precise location of point 162 along upper segment 148 is determined by the constant and length of spring 158 and other design parameters as known in the art.

Right and left upper segments 148 terminate in right and left plates 164 and 166 while right and left lower segments 152 terminate in right and left feet 170 and 172 via ankle-like plates 174 and 176. Plates 164 and 166 are provided with bearings 178 for supporting an axle 180 traversing therebetween best seen in FIGS. *3a* and *3b* which enables a scissor-like movement of legs 104 and 106 thereabout.

With reference now to FIG. *2c*, foot 170 is shown pivotally mounted on an anchor 182 which is in turn mounted on carriage 110. In a similar fashion, foot 172 is pivotally mounted on an anchor 184 which is in turn mounted on carriage 112. Front and rear shock absorbers 188 and 190, provided forward and rear of anchors 182 and 184, damp the pitch motion of feet 170 and 172 denoted by arrow B about anchors 182 and 184 during the gait-like motion of model 102.

Overall, when right leg 104 is forward, its respective knee-like joint 150 is flexed at approximately 15° and foot 170 is rotated about 15° in a counter-clockwise direction about anchor 182 to depress right rear shock absorber 190 while leg 106 is substantially straight and foot 172 is rotated about 15° in a clockwise direction about anchor 184 to depress left front shock absorber 188. In a similar but opposite fashion, when left leg 106 is forward, its respective knee-like joint 150 is flexed at approximately 15° and foot 172 is rotated about 15° in a counter-clockwise direction about anchor 184 to depress left rear shock absorber 190 while leg 104 is substantially straight and foot 170 is rotated about 15° in a clockwise direction about anchor 182 to depress right front shock absorber 188.

It should be noted that the above mentioned flexing of knee-like joints 150 and angles of rotation of feet 170 and 172 about anchors 182 and 184, respectively, are largely dependent on the length of the stride between left and right feet forward positions.

With reference now to FIGS. *3a–3c*, waist 108 is shown including a base 194 provided with right and left fixed bearings 198 and 200 and right and left slots 202 and 204 for supporting a balancing mechanism, generally designated 196, for maintaining a substantially even keel of model 102 during its gait-like motion. Balancing mechanism 196 includes a front balancing axle 206 supported by fixed bearings 198 and 200 and a rear balancing axle 208 mounted on rollers 207 for travelling along slots 202 and 204. The distance between front balancing axle 206 and rear balancing axle 208 is denoted a.

Front balancing axle 206 is rotatably driven by left leg 106 while rear balancing axle 208 is reciprocatingly driven by right leg 104. Balancing mechanism 196 achieves the substantially even keel of model 102 by the reciprocating movement of rear balancing axle 208 within slots 200 and 204 during the scissor-like movement of right and left legs 104 and 106 about axle 180. In particular, rear balancing axle 208 reciprocates from a most forward position denoted 209 when left leg 106 is forward, thereby minimizing distance a, to a most rear position denoted 211 when right leg 104 is forward, thereby maximizing distance a, through a neutral position denoted 210 when legs 104 and 106 are substantially perpendicular as shown in FIGS. *3a–3c*.

It should be noted that right and left plates 164 clear right and left fixed bearings 198 and 200 by virtue of inclined surfaces 212 best seen in FIGS. *2a* and *2b*, respectively, during the scissor-like movement of legs 104 and 106.

When either right leg 104 or left leg 106 is forward, waist 108 is at its lowest height $h_{min}$ while when legs 104 and 106 are substantially perpendicular, waist 108 is at its highest height $h_{max}$. The difference between $h_{max}-h_{min}$ is typically a few centimeters and is dependent on the length of stride between maximum left and right feet forward positions.

With reference now to FIGS. *4a* and *4b*, close-up views of driving system 118 shows that coupling between carriages 110 and 112 and carriages 122 and 124 is achieved by solenoid actuated bolts 214 and 216 of carriages 122 and 124 cooperating with bores 218 and 220 of carriages 110 and 112. Bolts 214 and 216 are under the control of controller 120.

Also shown is that terminals 134 and 136 are secured in position by solenoid actuated latches 222 and 224, under the control of controller 120, co-operating with grooves 226 and 228 of terminal 138 and grooves 230 and 232 of terminal 140. Terminals 138 and 140 are each provided with two grooves such that they can be rotated through 180° for reversing the engagements between carriages 110 and 112 and tracks 114 and 116. Carriages 110 and 112 are secured to terminals 138 and 140 by mechanical latches (not shown) during their rotation.

Figure 2A:
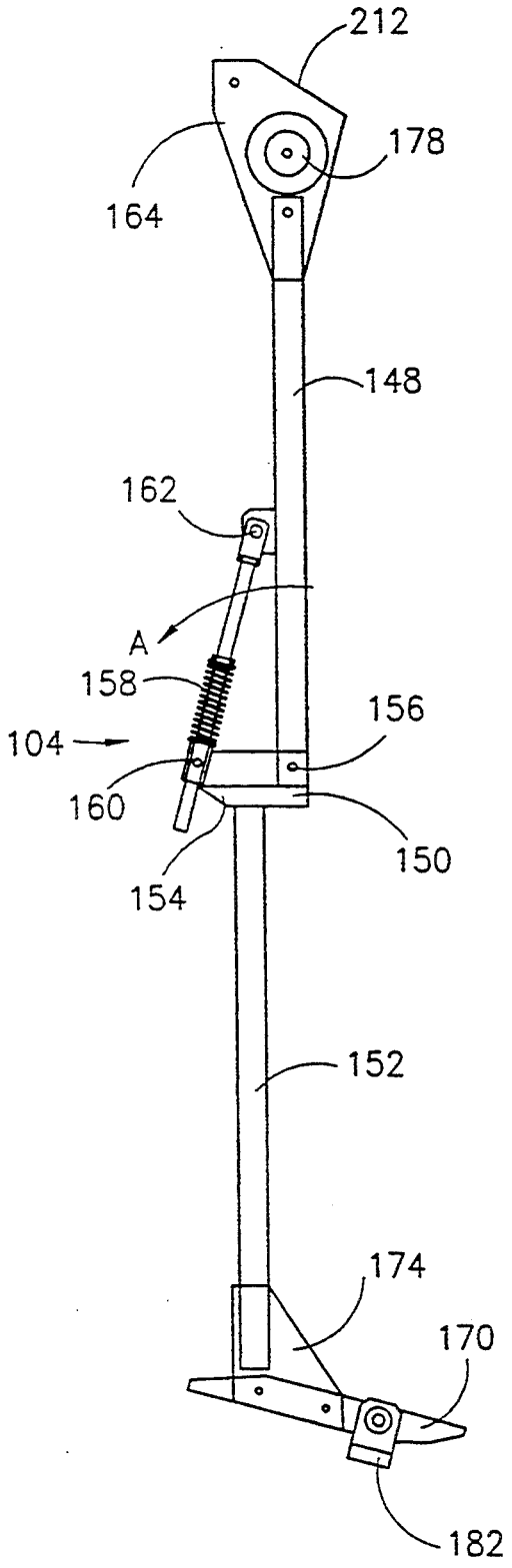
FIGS. 2*a* and 2*b* show close-up views of the right and left legs of the model.
Figure 2B:
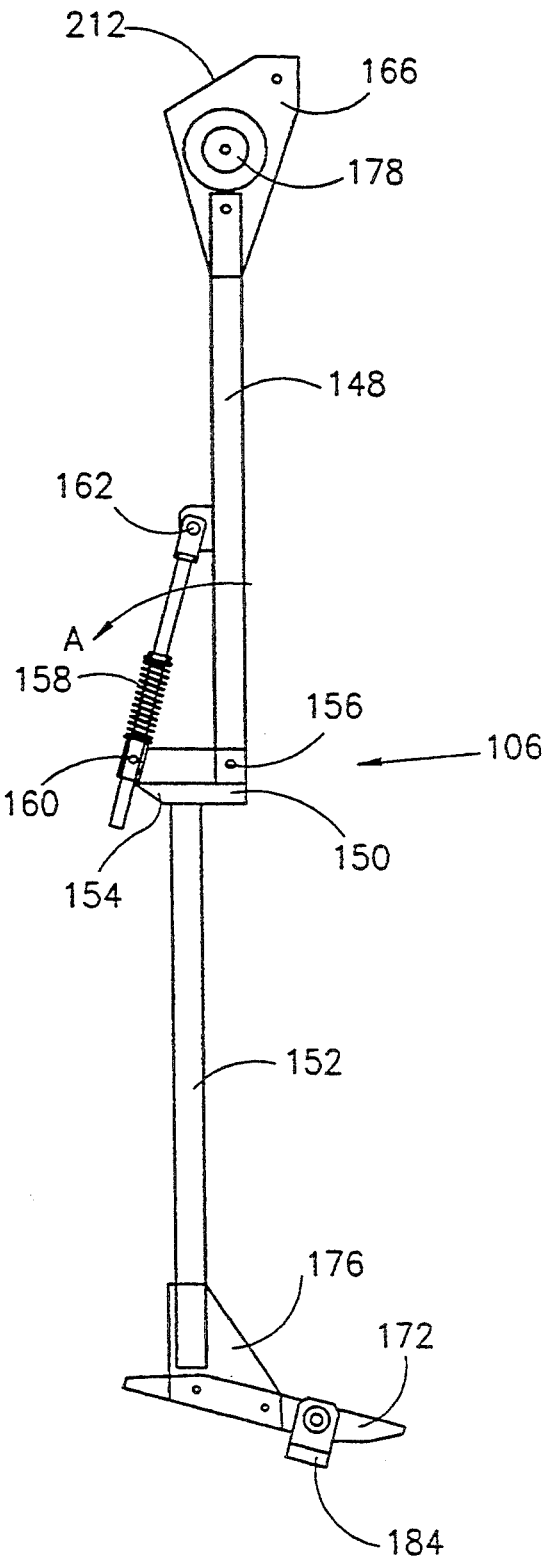
Figure 2C:
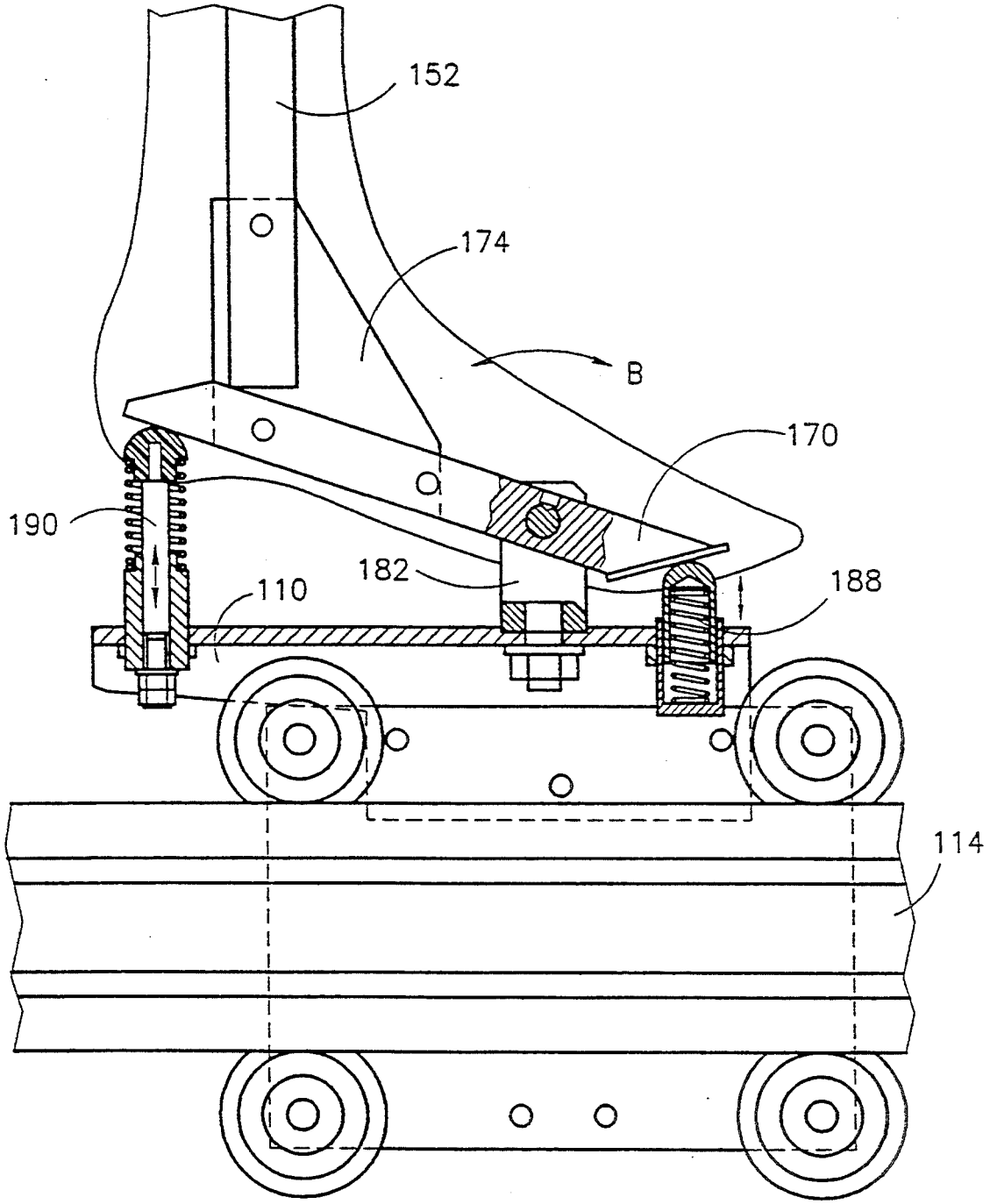
FIG. 2*c* shows a close-up view of the right foot of the model.
Figure 3A:
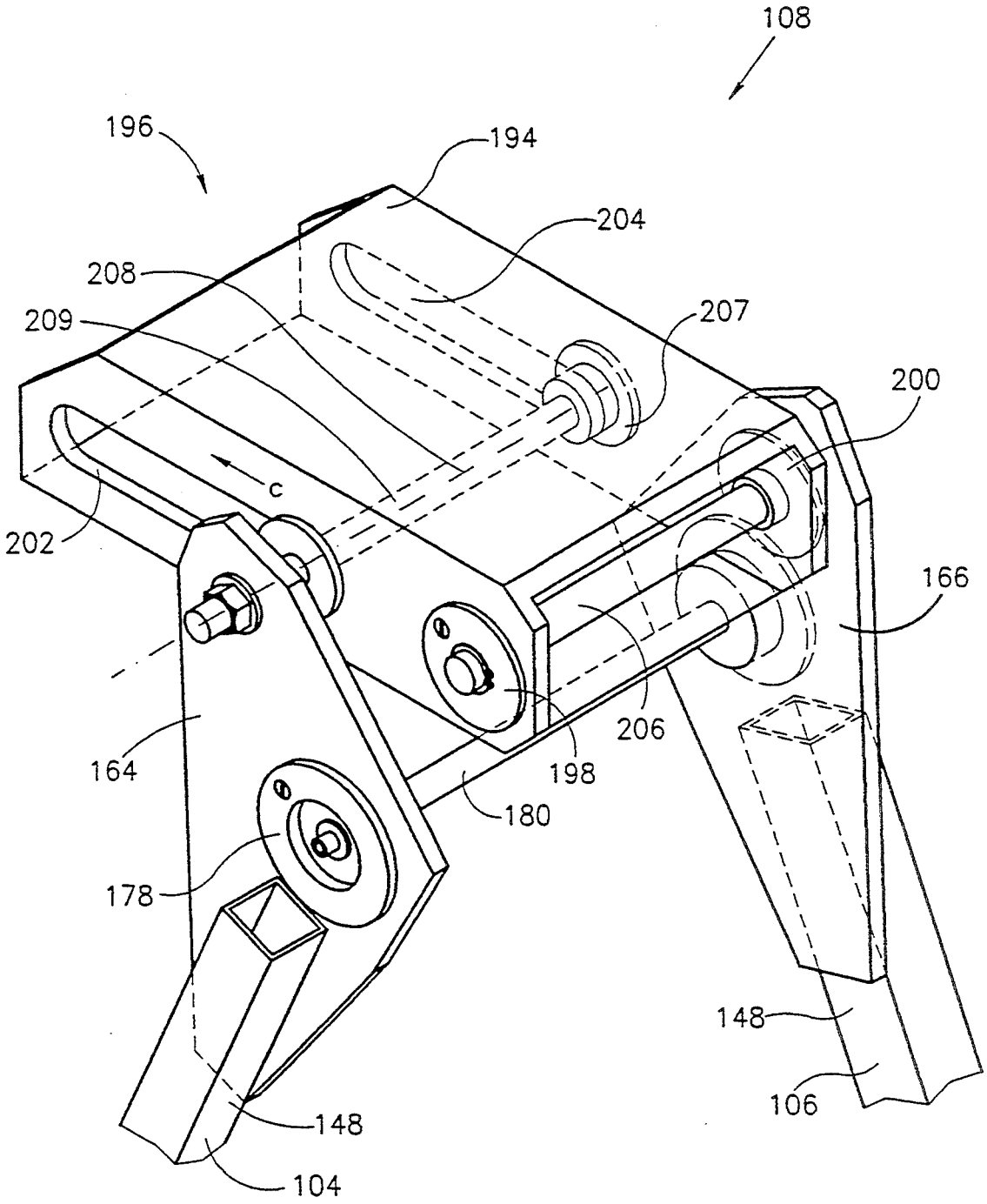
FIGS. 3*a*–3*c* show perspective views of the waist of the model in left foot forward, two legs together and right foot forward positions.
Figure 3B:
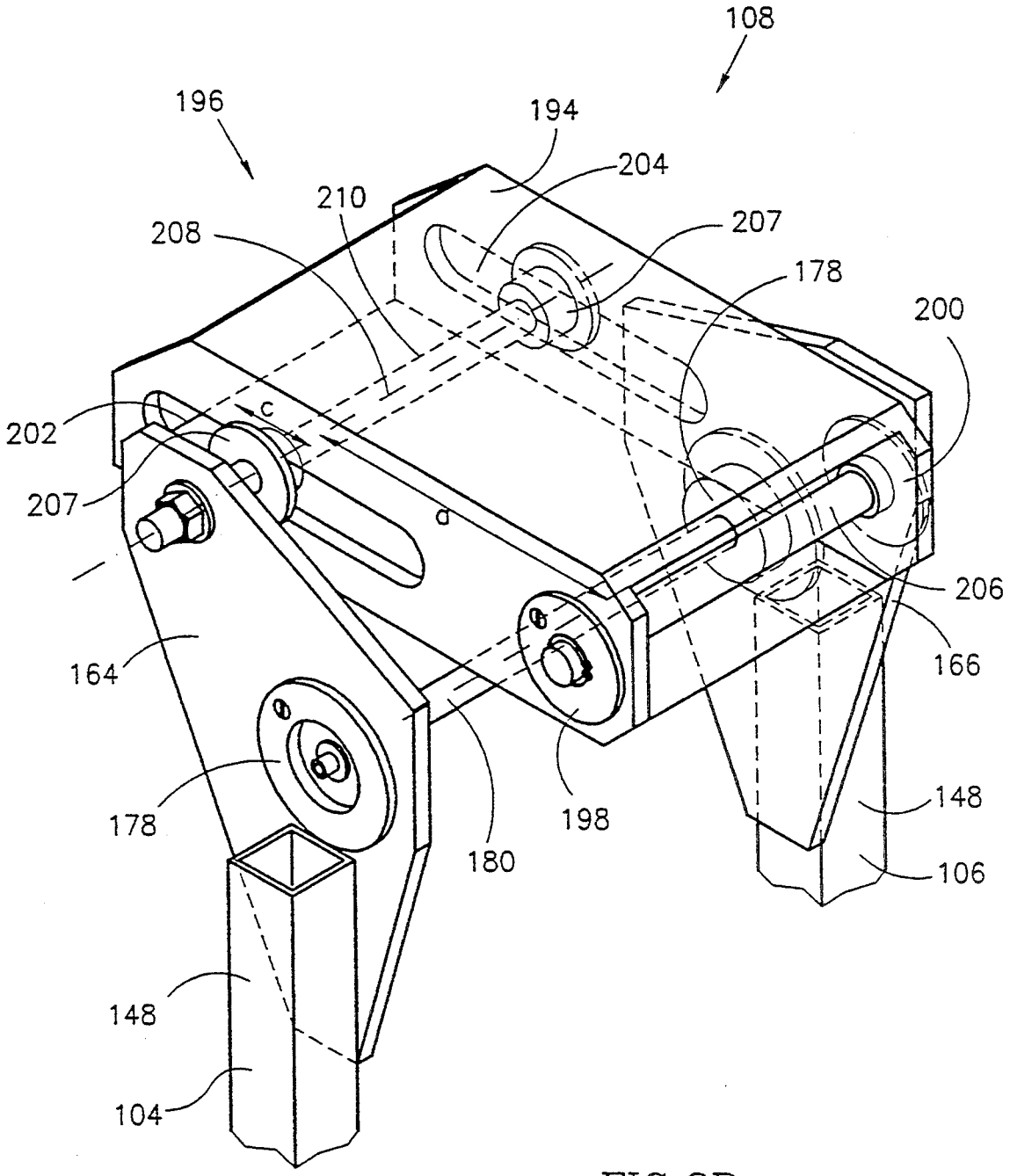
Figure 3C:
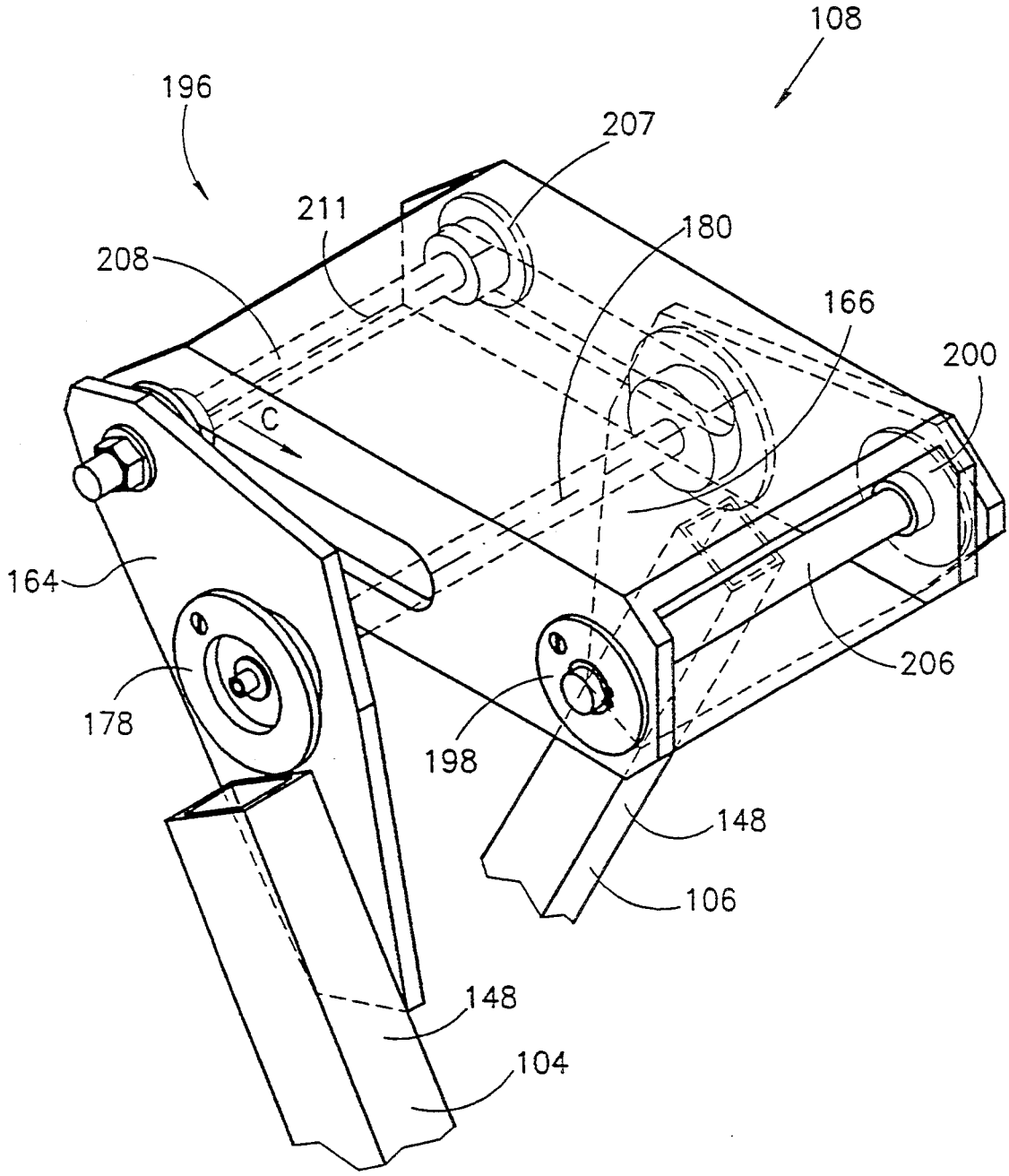
Figure 4A:
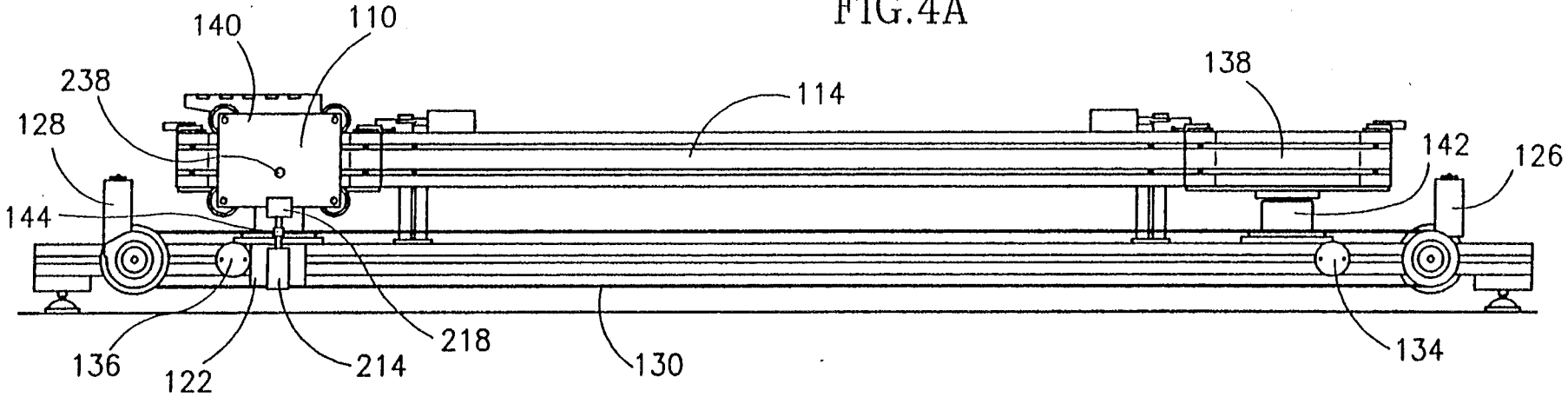
FIGS. 4*a* and 4*b* show side and front views of the driving system.
Figure 4B:
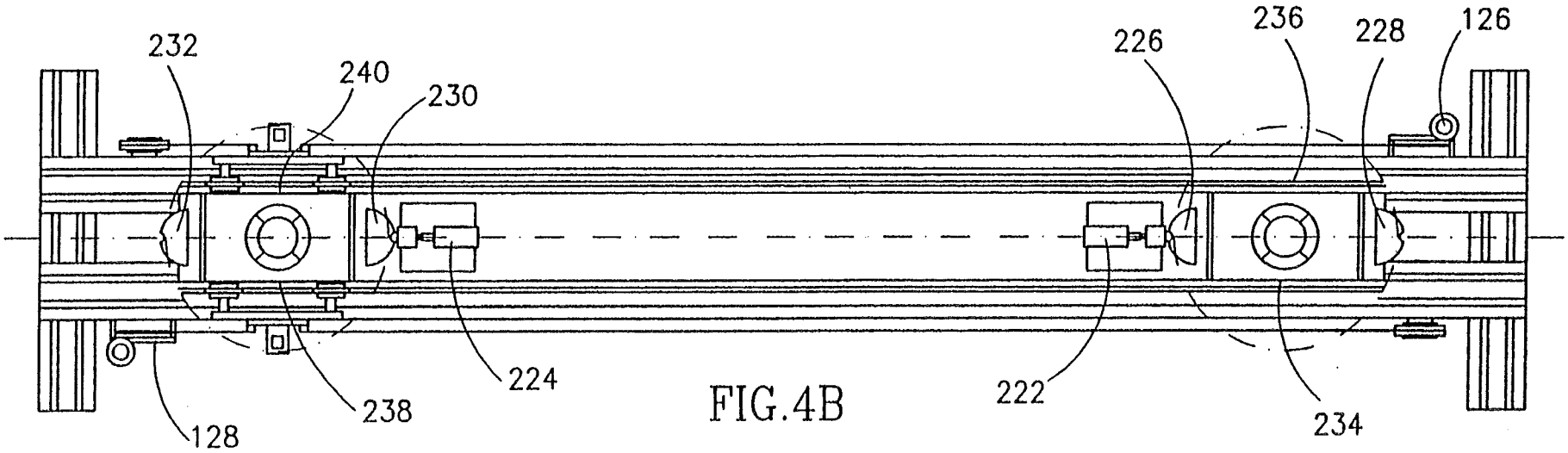

With reference now to FIGS. *5a–5d*, the simulating of human gait is shown in stages beginning with model 102 executing a right step from a left foot forward starting position. In practice, model 102 includes elements which are designed in terms of their weight, moments of inertia and other static and dynamic properties to spatially and temporally cooperate to perform the following motions embodied with human gait. First, the flexing denoted by arrow A on FIG. 2 and extending of legs 104 and 106 at knee-like joints 150. Second, the pitch motion denoted by arrow B of feet 170 and 172. And lastly, the reciprocating movement denoted by arrow C of rear balancing axle 208 about position 210 for maintaining a substantially even keel of model 102.

Figure 5A:
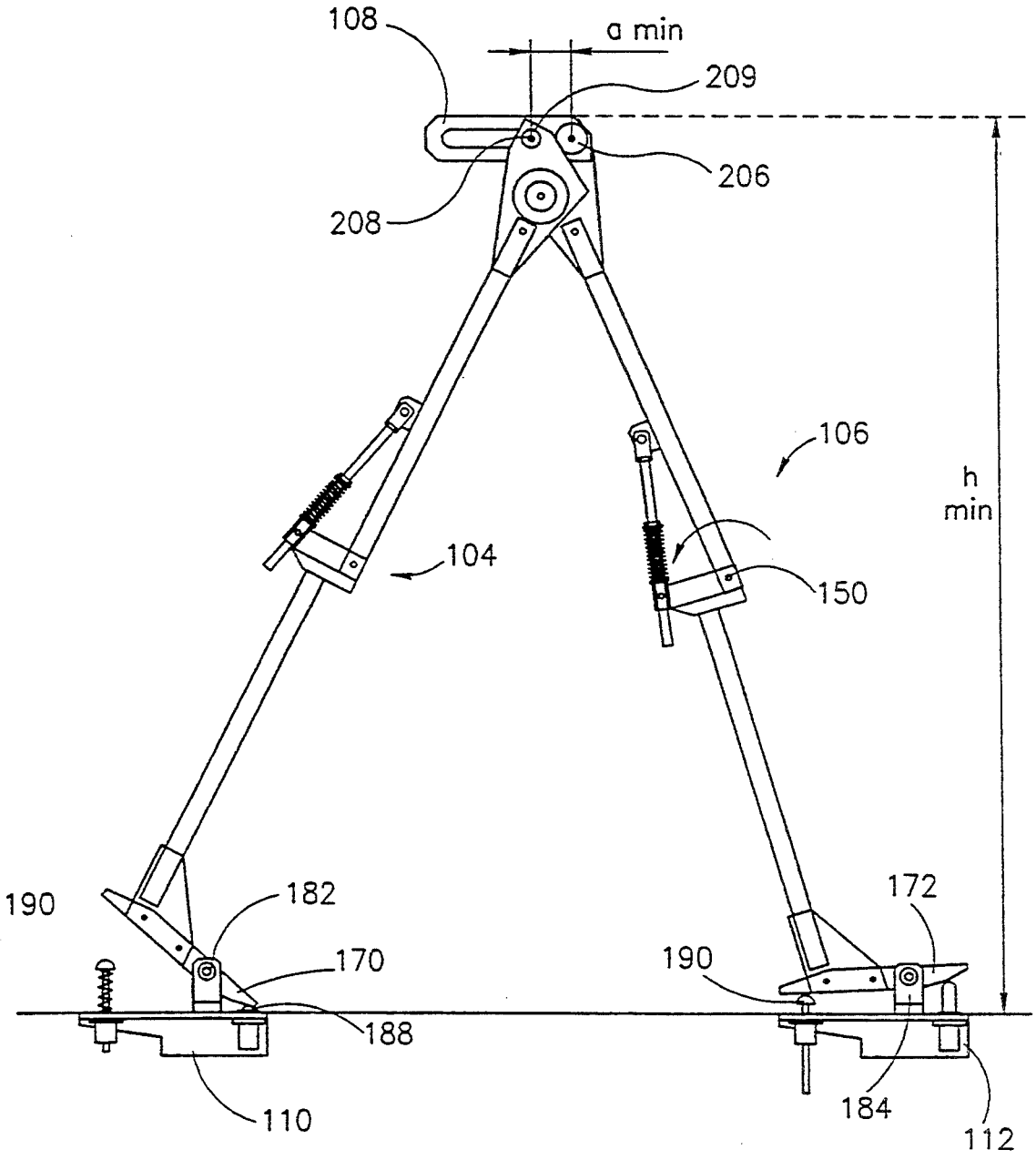
FIGS. 5*a*–5*d* show the model executing a right step from a left foot forward starting position.

With reference now to FIG. 5*a*, model 102 is shown in its left foot forward position, i.e., left foot 172 is approximately 60 cm forward of right foot 170, during a left-to-right walking routine. Hence, right and left legs 104 and 106 are in an open scissor-like position with respect to supporting axle 180 such that rear balancing axle 206 lies at position 209 minimizing distance a between front and rear balancing axles 206 and 208 and waist 108 is at its lowest height $h_{min}$. Furthermore, as left foot 172 is forward, its respective knee-like joint 150 is flexed at approximately 15° and foot 172 is rotated about 15° in a counter-clockwise direction about anchor 184 to depress left rear shock absorber 190 while leg 104 is substantially straight and foot 170 is rotated about 15° in a clockwise direction about anchor 182 to depress right front shock absorber 188.

As right foot 170 "takes-off" from its standing position and begins to move towards the right, right and left legs 104 and 106 perform a closing scissor-like movement about supporting axle 180 as waist 108 i.e. model 102 moves to the right, thereby causing plate 164 to pitch in a counter clockwise direction and left plate 164 to pitch in a clockwise direction about supporting axle 180 such that rear balancing axle 208 slides from its position 209 to the left to ensure a substantially even keel of waist 108. At the same time, as right and left feet 170 and 172 converge, right foot 170 begins to pitch in a counter clockwise direction about right anchor 182 while left leg 106 begins to straighten and left foot 172 begins to pitch in a clockwise direction about left anchor 184.

Figure 5B:
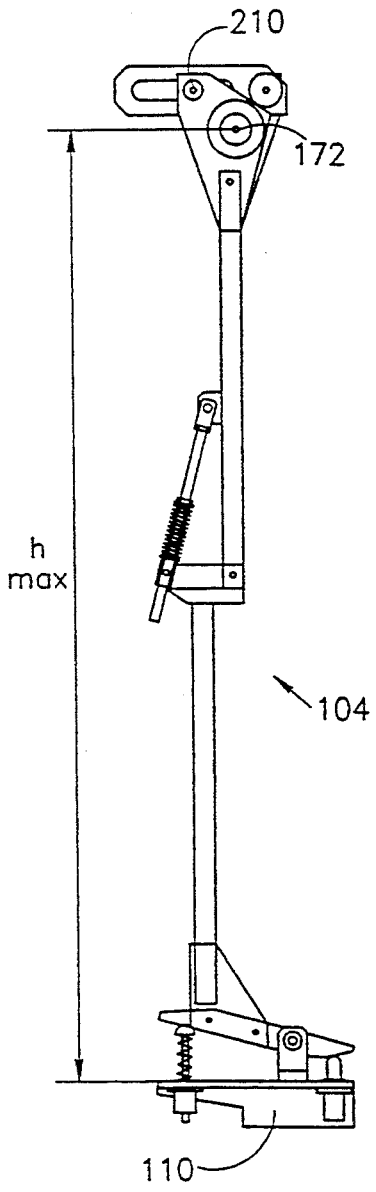

With reference now to FIG. 5*b*, as right foot 170 continues to move to the right until it is side-by-side with left foot 172, legs 104 and 106 are substantially perpendicular such that rear balancing axle 208 is at position 210 and waist 108 is at its greatest height denoted $h_{max}$.

Figure 5C:
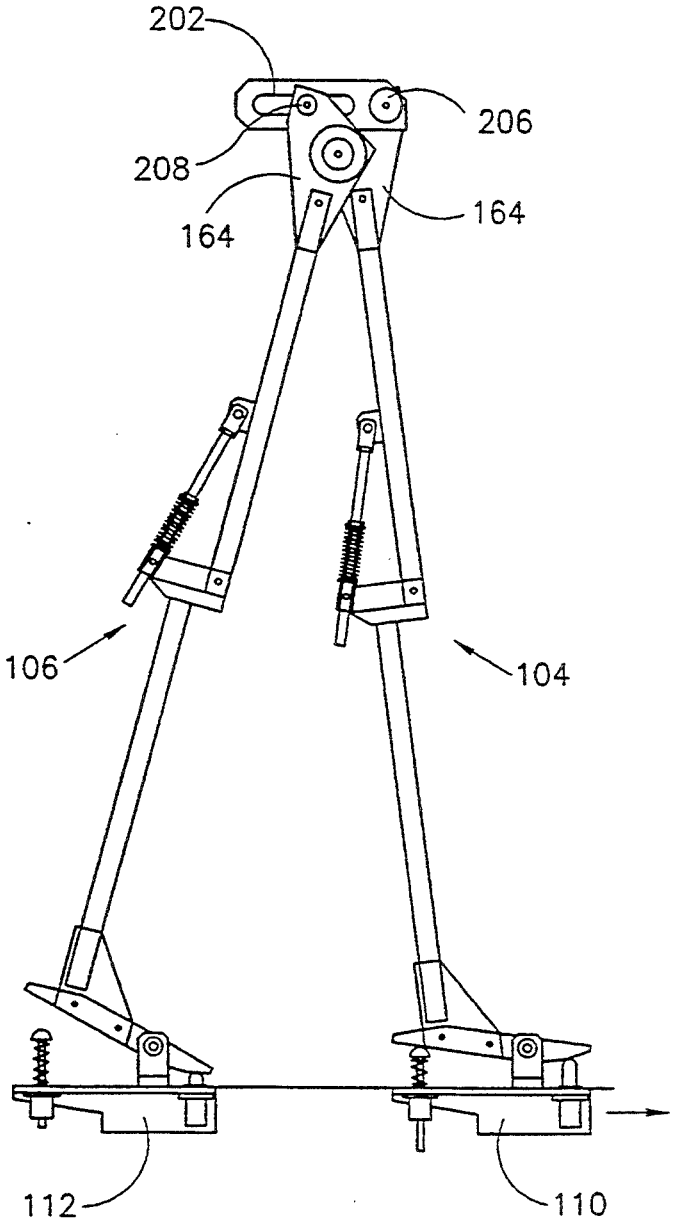

Turning now to FIG. 5*c*, right and left legs 104 and 106 begin to perform an opening scissor-like movement about supporting axle 180 as the right step progresses and waist 108 i.e. model 102 continues to move to the right. The opening scissor-like movement causes right plate 164 to continue to pitch in a counter clockwise direction and lea plate 164 to continue to pitch in a clockwise direction about supporting axle 180 such that rear balancing axle 208 slides from position 210 to the left towards position 211. At the same time, right foot 170 continues to pitch in a counter clockwise direction about right anchor 182 while left foot 172 continues to pitch in a clockwise direction about left anchor 184 as right and left legs 104 and 106 diverge.

Figure 5D:
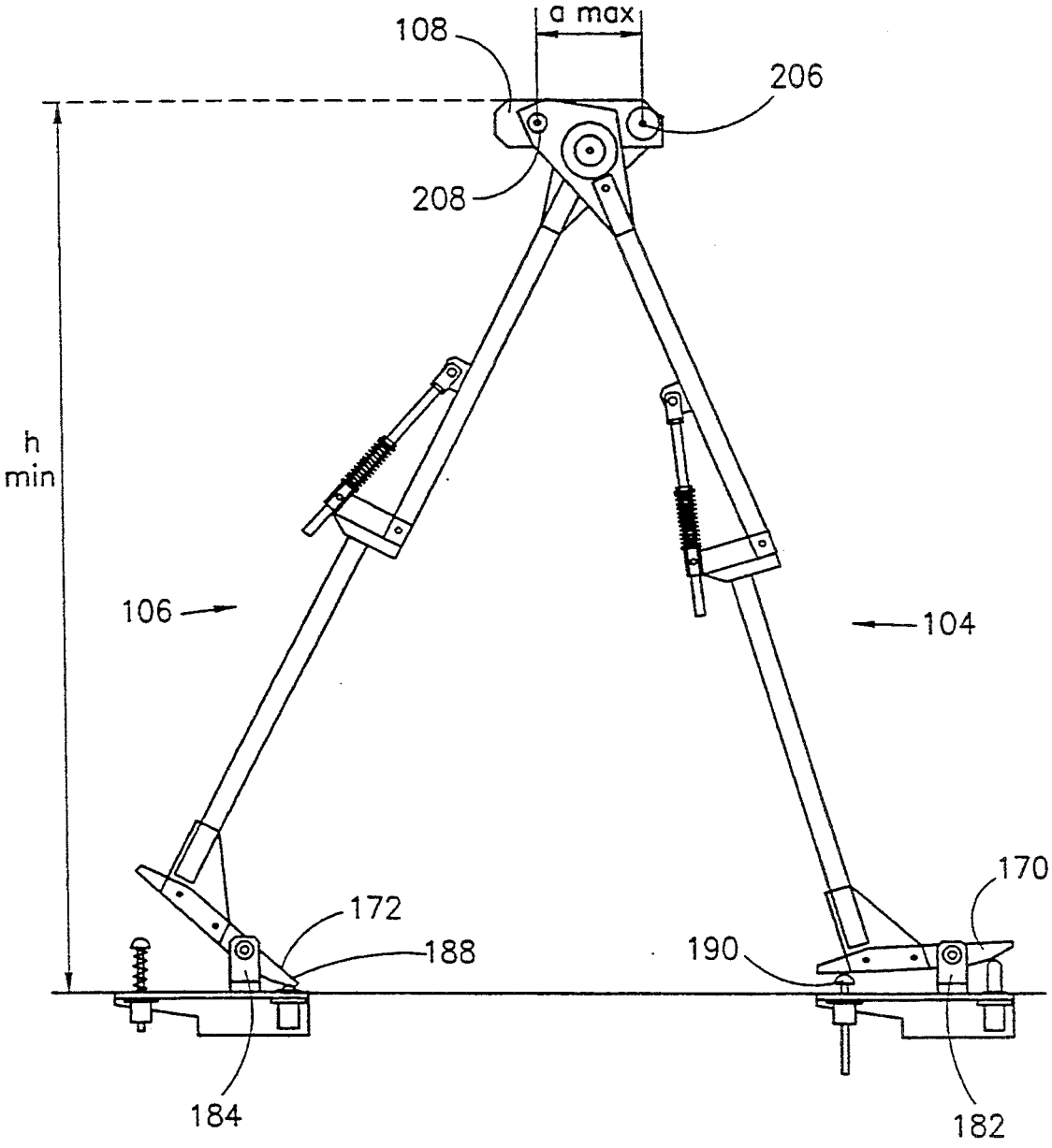

Turning now to FIG. 5*d*, model 102 is shown at its greatest right foot forward stride position after right foot 170 finally "lands". In this position, right leg 104 is flexed at approximately 15° its respective knee-like joint 150 and foot 170 is rotated about 15° in a counter-clockwise direction about anchor 182 to depress right rear shock absorber 190 while leg 106 is substantially straight and foot 172 is rotated about 15° in a clockwise direction about anchor 182 to depress left front shock absorber 188. Additionally, rear balancing axle 206 lies at a position 211 rear of position 210 such that distance a between front and rear balancing axles 206 and 208 is maximized and waist 108 is again at its lowest height $h_{min}$.

Controller 120 alternately drives right and left legs 104 and 106 step-by-step along tracks 114 and 116 in a gait-like motion until limit switches 134 and 135 detect arrival of model 102 at the right end of tracks 114 and 116. A typical step takes approximately 3 seconds, and therefore model 102 takes approximately 30 seconds to make the four steps to walk the 1.80 m from one end of tracks 114 and 116 to the other.

Limit switches 134 and 135 provide signals to controller 120 to reverse engagements between carriages 110 and 112 and tracks 114 and 116 such that driving system 118 can advance model 102 in a right-to-left direction according to the following sequence of events. First, controller 120 retracts bolts 214 and 216 of carriages 122 and 124 from bores 218 and 220 of carriages 110 and 112. Second, mechanical latches 234 and 236 engage carriages 110 and 112 to secure carriages 110 and 112 to terminal 138. Third, controller 120 retracts latch 222 from groove 226 of terminal 138, actuates motor 142 to rotate terminal 138 through 180° and then inserts latch 222 into groove 228 of terminal 138. Fourth, controller 120 inserts bolts 214 and 216 of carriages 122 and 124 into bores 220 and 218 of carriages 112 and 110 such that the engagements between carriages 110 and 112 and tracks 114 and 116 are reversed for right-to-left advancement of model 102.

In a similar fashion as before, controller 120 alternately drives right and left legs 104 and 106 step-by-step along tracks 114 and 116 in a gait-like motion until limit switches 136 and 137 detect arrival of model 102 at the left end of tracks 114 and 116. At this time, limit switches 136 and 137 provide signals to controller 120 which then performs a similar sequence of events as described above to reverse engagements between carriages 110 and 112 and tracks 114 and 116 such that driving system 118 can advance model 102 in a left-to-right direction again.

While the invention has been described with respect to a limited number of embodiments, it will be appreciated that many variations, modifications and other applications of the invention may be made including providing motors to the carriages driving the step-by-step advancement of the model along the tracks.

What is claimed is:

1. A system comprising:

(a) a first track;

(b) a second track substantially parallel to said first track;

(c) an object having a left leg and a right leg, said left leg advancing along one of either said first track or said second track, said right leg advancing along the other of said first track or said second track, each leg of said object including:

i) an upper segment, ii) a lower segment pivotally connected to said upper segment at a flexible knee-like joint such that said leg has a tendency for a flexion movement, and iii) urging means connected to said upper segment and to said lower segment for straightening said leg; and (d) driving means for intermittently and alternately advancing said left leg and said right leg such that said object advances along said first and second tracks.

2. The system as in claim 1 wherein a leg of said object terminates in a foot pivotally connected thereto, said foot being provided with front and rear shock absorbers for smoothing the pitch motion of said foot about said leg during advancement along either said first track or said second track.

3. The system as in claim 1 wherein said object includes a balancing mechanism for maintaining a substantially even keel of said object during the advancement along said first and second tracks.

4. The system as in claim 1 wherein said second track is of substantially the same length as said first track, said first and second tracks terminating at a first end and a second end, said object being advanced along said first and second tracks either in a first direction from said first end to said second end or in a second direction from said second end to said first end, the system further comprising:

(e) a first terminal at said first end for reversing the direction of advancement of said object from said first direction to said second direction; and (f) a second terminal at said second end for reversing the direction of advancement of said object from said second direction to said first direction.

5. A system comprising:

(a) a first track;

(b) a second track, said second track being substantially parallel to and of substantially the same length as said first track, said first and second tracks terminating at a first end and a second end;

(c) an object having a left leg and a fight leg, said object being advanced along said first and second tracks, said left leg advancing along one of either said first track or said second track, said fight leg advancing along the other of said first track or said second track;

(d) driving means for intermittently and alternately advancing said left leg and said right leg such that said object advances along said first and second tracks either in a first direction from said first end to said second end or in a second direction from said second end to said first end;

(e) a first terminal at said first end for reversing the direction of advancement of said object from said first direction to said second direction; and (f) a second terminal at said second end for reversing the direction of advancement of said object from said second direction to said first direction.

6. The system as in claim 5 wherein a leg of said object includes:

i) an upper segment, ii) a lower segment pivotally connected to said upper segment at a flexible knee-like joint such that said leg has a tendency for a flexion movement, and iii) urging means connected to said upper segment and to said lower segment for straightening said leg.

7. The system as in claim 5 wherein a leg of said object terminates in a foot pivotally connected thereto, said foot being provided with front and rear shock absorbers for smoothing the pitch motion of said foot about said leg during advancement along either said first track or said second track.

8. The system as in claim 5 wherein said object includes a balancing mechanism for maintaining a substantially even keel of said object during the advancement along said first and second tracks.

* * * * *